US008887641B1

(12) United States Patent
Manole et al.

(10) Patent No.: US 8,887,641 B1
(45) Date of Patent: Nov. 18, 2014

(54) 40 MM LOW DRAG EXTENDED RANGE PROJECTILE

(71) Applicants: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US); Wilfredo Toledo, Hasbrouck Heights, NJ (US)

(72) Inventors: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US); Wilfredo Toledo, Hasbrouck Heights, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 43 days.

(21) Appl. No.: 13/761,736

(22) Filed: Feb. 7, 2013

Related U.S. Application Data

(60) Provisional application No. 61/599,580, filed on Feb. 16, 2012.

(51) Int. Cl.
*F42B 14/06* (2006.01)

(52) U.S. Cl.
CPC ..... *F42B 14/06* (2013.01)
USPC ..... 102/521

(58) Field of Classification Search
CPC ..... F42B 14/06; F42B 14/08
USPC ..... 102/473, 520–522, 439
See application file for complete search history.

(56) References Cited

U.S. PATENT DOCUMENTS

| | | | | | |
|---|---|---|---|---|---|
| 3,551,972 | A | * | 1/1971 | Engel | 86/52 |
| 3,780,658 | A | * | 12/1973 | de Longueville et al. | 102/518 |
| 4,142,467 | A | * | 3/1979 | Stahlmann et al. | 102/523 |
| 4,671,179 | A | * | 6/1987 | Synofzik et al. | 102/430 |
| 4,773,331 | A | * | 9/1988 | Rossman | 102/520 |
| 4,860,661 | A | * | 8/1989 | Bock et al. | 102/523 |
| 5,214,238 | A | * | 5/1993 | Young | 102/520 |

* cited by examiner

*Primary Examiner* — Reginald Tillman, Jr.
(74) *Attorney, Agent, or Firm* — Michael C. Sachs

(57) ABSTRACT

A 40 mm ammunition projectile for firing without significant spin in an M203 or an M320 grenade launcher. The ammunition includes a projectile body having hollow inner cavity therein for an explosive warhead; a projectile fin assembly; a projectile nose element having a conically shaped front area thereon; a decoupled projectile sabot in two or more joining sabot petals enclosing the body; a base cartridge case having vent holes, a bowl area for placement of a copper closure cup containing propellant therein, and a closure plug for threading into the rear of said cartridge case. The projectile fin assembly may provide a canted angle on each fin blade to (relatively very slowly) spin up the round at less than 30 Hz. Projectiles with body length less than five inches may be launched in an M203 grenade launcher while projectiles with body length up to eight inches may be launched in an M320 grenade launcher.

10 Claims, 4 Drawing Sheets

40 MM LOW DRAG EXTENDED RANGE PROJECTILE

CROSS-REFERENCE TO RELATED APPLICATIONS

The present application claims the benefit of priority of U.S. provisional patent application Ser. No. 61/599,580 filed on Feb. 16, 2012, which is incorporated by reference herein.

U.S. GOVERNMENT INTEREST

The inventions described herein may be made, used, or licensed by or for the U.S. Government for U.S. Government purposes.

BACKGROUND OF INVENTION

Projectiles currently used for the M203/M320 include the M433 High Explosive Dual Purpose Round, M406 High Explosive Round, M583A1 Star Parachute Round, M585 White Star Cluster Round, M713 Ground Marker Round, M781 Practice Round, M651 CS Round and M576 Buckshot Round. The M203 is not a standalone gun. It must be attached to an M16 or M4 rifle, for instance, and fires a family of 40 mm low velocity projectile rounds. In order to load a 40 mm round into an M203, the forward sleeve of the gun tube is slid forward, and a 40 mm round is pushed into the sleeve. The sleeve is then slid backwards and locked into position, ready to fire. The barrel of the M203 is rifled, which spins up the projectile as it travels down the barrel tube, and the projectile leaves the gun tube with a high spin rate.

The 40 mm cartridge case is typically not reused or recycled after firing. If the cartridge case gets stuck in the gun tube, there is a tool to help the war-fighter push it from the tube. The M320 fires the same 40 mm low velocity ammunition as the M203. There are several improvements that the M320 has compared to the M203. The M320 has stand alone single shot capability and may be fired by the war-fighter without attaching to a gun. It also has the capability to be attached to and fired from the M16/M4 rifle, similarly to the M203. A major improvement of the M320 is the ability of the firing tube to open sideways. By opening sideways, longer ammunition can be loaded into the M320 gun tube as compared to loading in an M203. While the approximate maximum length of the projectile is approximately five inches in the M203, projectiles several inches longer can be loaded into an M320. Both M203 and M320 have rifled barrels which induce spinning in the projectile as it travels through the gun tube.

There exists a great need to eliminate projectile spinning, when fired from M203 or M320 Grenade Launcher guns. To permit increased accuracy and precision hits on targets as far range as beyond 1000 meters (a goal which is sought) it is necessary to provide projectile guidance, navigation and/or control subsystem components within the projectiles. However, guidance, navigation and control subsystems cannot function properly if the projectile were spinning at any appreciable revolution rate. Guided ammunition would need to have no spin (or very little spin) so that the seeker or camera therein, e.g., can see the target clearly while in flight. The conventional M203 or M320 Grenade Launcher guns launch spinning low velocity 40 mm projectiles because the Grenade Launcher tube barrels have internal rifling intended to spin up the projectiles (at approximately 1800 revolutions per second) for stabilization of flight. Clearly then, a way must be found to avoid this spin which is inherent in conventional M203 or M320 Grenade Launcher guns.

BRIEF SUMMARY OF INVENTION

An entirely new projectile is presented for use in the M203 or M320 Grenade Launchers which will not be appreciably spun up by the launcher barrel rifling at all, because the projectile body is decoupled from the sabot petals and the (slip type) obturator means, the latter are the only two projectile elements which might have engaged the rifling in the Grenade Launcher tube barrel. Even if either or both of these two elements were at all spun up by the rifling, they are decoupled from the projectile body, and thus will not appreciably spin up the projectile body.

OBJECTS OF THE INVENTION

Accordingly, it is an object of the present invention to provide means for an ammunition projectile to be launched (without spin on the launched projectile in flight) from a conventional M320 grenade launcher gun.

Another object of the present invention to provide means for launching a guided munition in an M320 grenade launcher gun.

It is a further object of the present invention to provide extended range for an ammunition projectile fired from an M320 grenade launcher gun through effectively providing a longer gun tube path during firing.

It is another object of the present invention to provide a new 40 mm low drag extended range projectile for firing in either of, or in both of, an M203 or an M320 grenade launcher.

It is a yet further object of the present invention to provide a new 40 mm low drag extended range projectile for firing in either of, or in both of, an M203 or an M320 grenade launcher which will dramatically improve the range and accuracy of the fired projectile.

It is a still further object of the present invention to provide a new 40 mm low drag extended range projectile for firing in either of, or in both of, an M203 or an M320 grenade launcher which will dramatically increase the velocity of the fired projectile.

It is still another object of the present invention to provide a new 40 mm low drag extended range projectile for firing in either of, or in both of, an M203 or an M320 grenade launcher with more lethality where the new projectile carries more energetic material or more fragmentation projectiles as cargo, due to an enhanced length of the new projectile.

It is a yet further object of the present invention to provide a new 40 mm low drag extended range projectile with an improved cartridge case that can be reused again and again, resulting in cost benefits, with less environmental impact, thereby.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention. The invention for example could be used on grenade launchers other than an M320, including stand alone devices to receive a grenade launcher, other types of shoulder launched weapons, or weapons other than grenade launchers, and for ammunition other than necessarily the caliber or types shown here, where the principles of the invention might be beneficially employed.

LIST OF DRAWINGS

DETAILED DESCRIPTION

Figure 1:
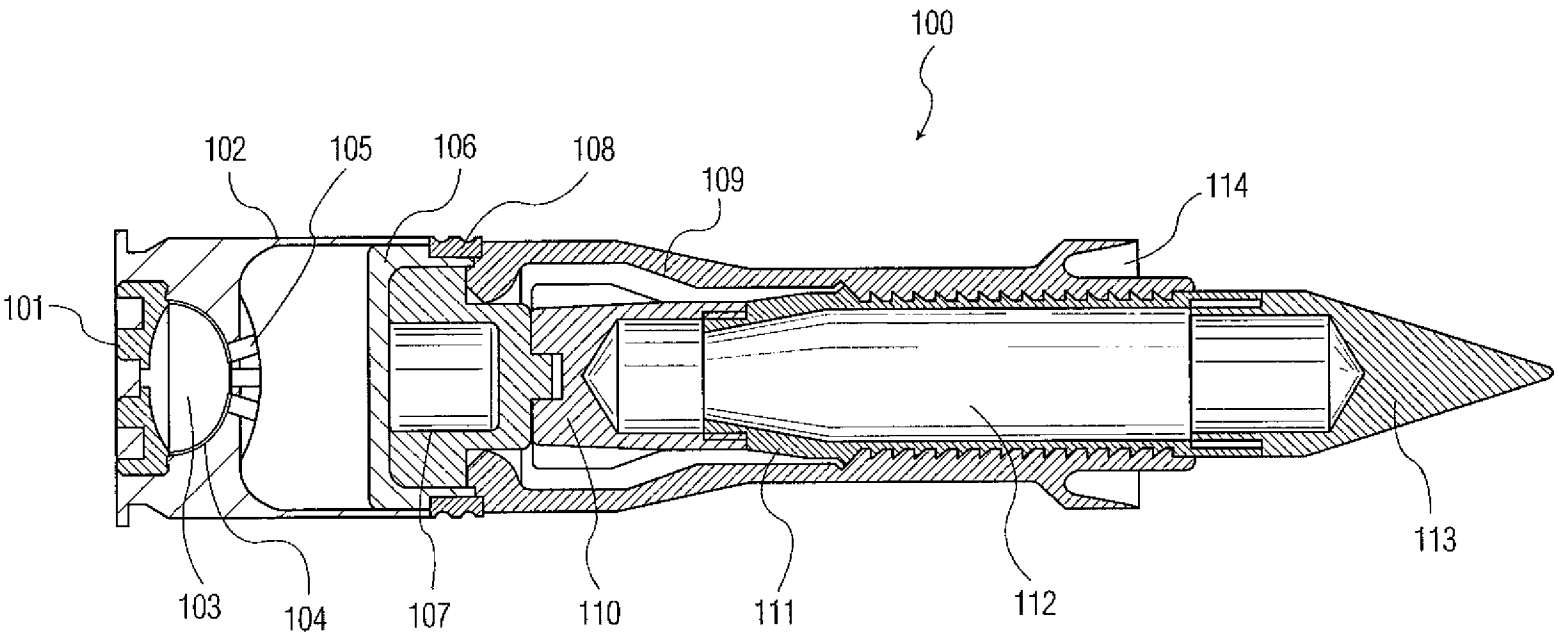
FIG. 1 shows a cutaway view of a new 40 mm low drag extended range projectile according to this invention.
Figure 2:
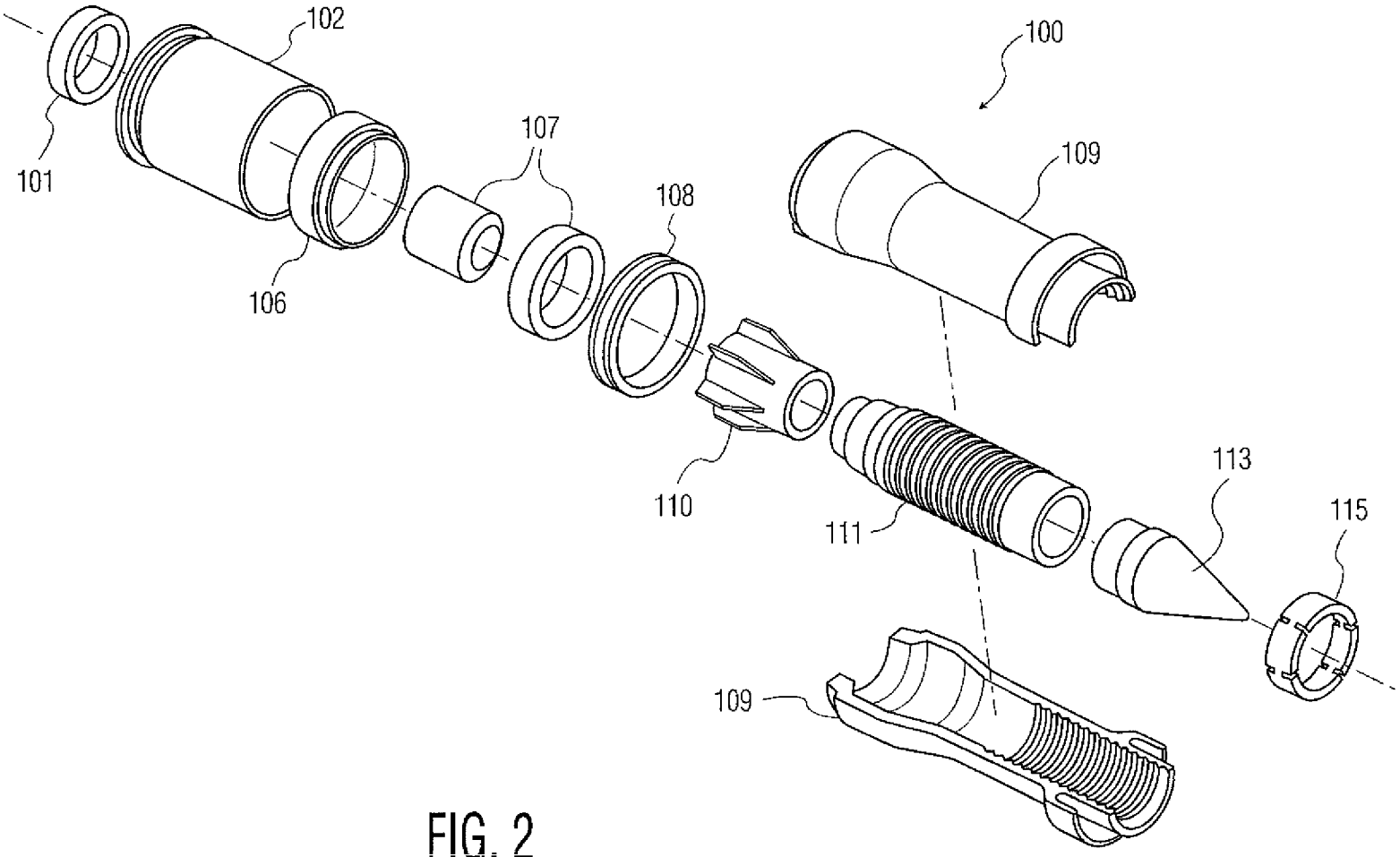
FIG. 2 shows an exploded view of the new 40 mm low drag extended range projectile according to this invention.
Figure 3:
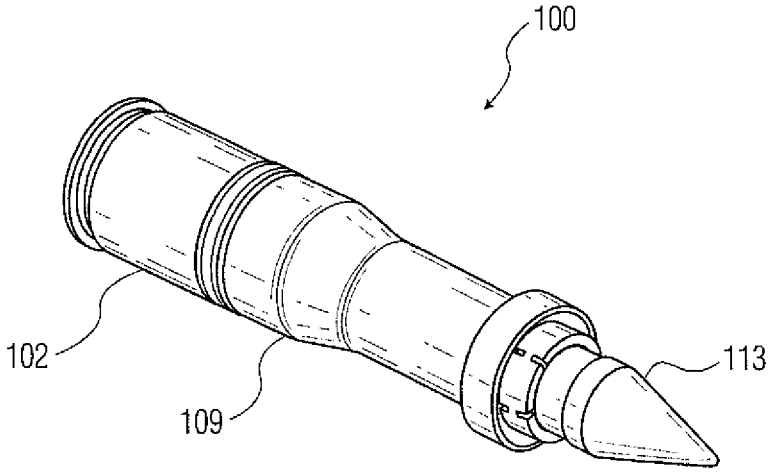
FIG. 3 shows a view of an assembled new 40 mm low drag extended range projectile according to this invention.
Figure 4:
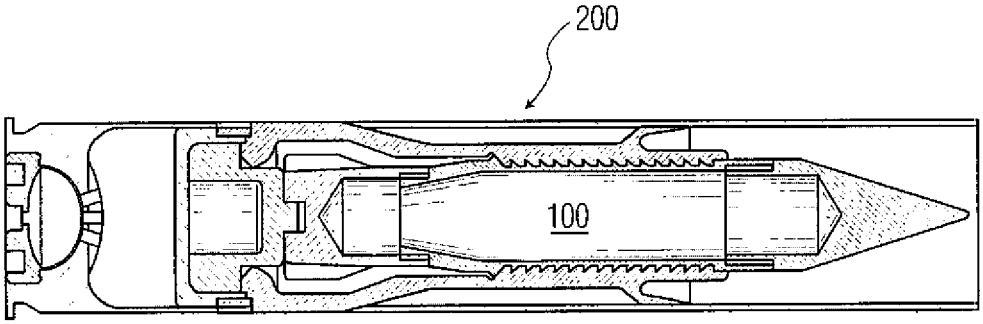
FIG. 4 shows a partial cross sectional view of the new 40 mm low drag extended range projectile according to this invention.
Figure 5:
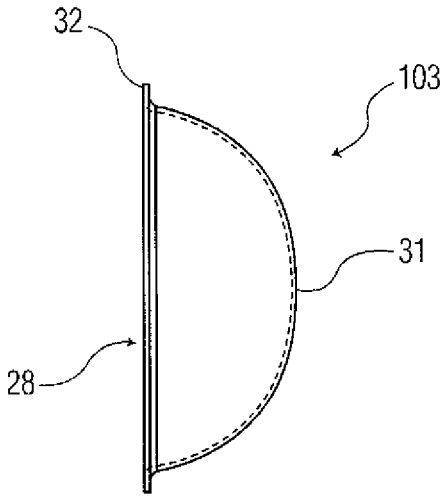
FIG. 5 shows a propellant closure cup for a 40 mm gun sleeve cartridge case according to this invention.
Figure 6:
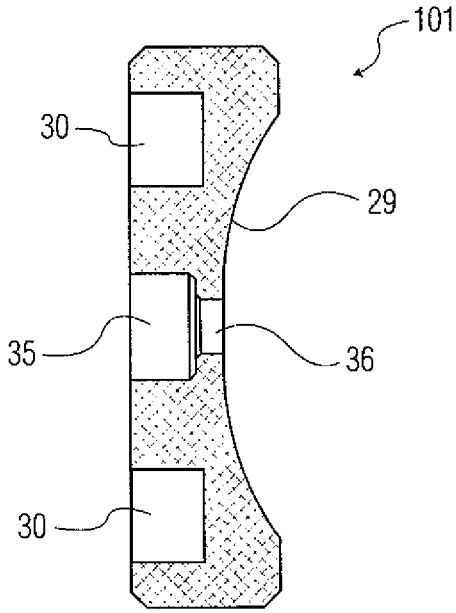
FIG. 6 shows a base plug for a 40 mm gun sleeve cartridge case according to this invention.

Shown in FIGS. 1-6 is new 40 mm low velocity ammunition for the M320 and M203, which can be fired without a sleeve (200), to provide extended range and higher accuracy and precision on target with improved lethality. This 40 mm low drag extended range projectile 100 has been designed to fit into the M203 and M320 low velocity guns. The length of the projectile 100 can be varied from 4 inches up to 8 inches by changing the length of body 111 and/or possibly of the nose 113. This 40 mm low drag extended range projectile 100 can be loaded into new cartridge case 102 (see FIGS. 1-3) or even into a 40 mm M320 full length type gun sleeve cartridge case 200 (see FIG. 4). Cartridge case 102 is restricted to fit just into the smooth part of the M320 gun tube section (which is encountered right before the rifled section of the gun tube barrel). Closure plug 101 can be threaded or pressed into cartridge case 102. Propellant bowl area 104 of cartridge case 102 has a much larger volume than known/used before now. Propellant bowl area 104 has a new shape which allows for more propellant and therefore higher velocity of the projectile with efficient burn for higher velocity per pressure output. Copper closure cup (see FIGS. 1 and 5) 103 has a lip 32 that mates with closure plug 101 (see FIGS. 1, 2 and 6) and prevents propellant from coming out of the cup through vent holes 105 (a possible number of vent holes could be six). This allows for the round to be rough handled without the threat of propellant being lost through vent holes 105, which might affect velocity and pressures of the projectile. Upon firing of the propellant, the copper cup 103 will immediately melt away and the pressure of expanding gases caused by the burned propellant (approximately 4000 psi, e.g.) will be of sufficient pressure (approximately 300 psi, e.g.) needed to blow through vent holes 105 and propel a round thereby. Cartridge case 102 has been reused in government testing over at least six times. It is therefore considered a re-useable part for these rounds. FIG. 2 is an exploded view of the 40 mm low drag extended range projectile 100. The round is assembled as follows: cup 106 (plastic, composite or metal) is placed on a table with the cup's open end faced up. Spacer 107 is placed in the cup 106 with the spacer's nipple faced up. Obturator 103 is then also placed on cup 106. Fin 110 is threaded into body 111. Explosive/warhead/liner (not shown here) is filled into cavity 112. Nose 113 (possibly containing a fuze or a stab detonator, not shown here) is threaded into body 111. Projectile assembly (fin 110, body 111 and Nose 113) are placed into sabot petal(s) 109 as shown in FIG. 2 cutaway drawing. Sabot(s), (2 or 3 petals), are closed. The assembly of (fin 110, body 111, nose 113, sabot(s) 109) is pressed into cup assembly (cup 106, spacer 107, obturator 108) to form the projectile assembly. The projectile assembly is then pressed into the improved new cartridge case 102. Break ring 115 is optional (it holds the parts of the projectile in place before ready for use and is broken off before use ordinarily but launching would break it off anyway). The projectile assembly is turned with bottom of the (new) cartridge case 102 facing up. Copper closure cup 103 is placed into bowl area 104 of cartridge case 102. Propellant is added to copper closure cup 103 and closure plug 101 is closed. The 40 mm low drag extended range projectile 100 is ready to be stored or fired. FIG. 3 shows the assembled 40 mm low drag extended range projectile 100, with the improved cartridge case 102, ready to be loaded and fired. At the same initial service velocity (approximately 78 meters/second), the 40 mm low drag extended range projectile 100 flies a flatter trajectory, greater distance/extended range, compared to conventional 40 mm low velocity projectile(s). This is due to the fact that the 40 mm low drag extended range projectile 100 discards the sabot(s) 109 upon exiting the M203 or M320 tube. The projectile then has a reduced drag and better aerodynamic flight profile. This profile includes less coning, reduced pitch and yaw and less velocity decay. Due to this improved cartridge case 102, more propellant can be added and will provide extra velocity to the projectile. Testing has shown an increase in velocity from 78 meters/second to 120 meters/second, while still being safe to fire in an M203 or M320 gun. Due to the improved aerodynamic flight profile and improved velocity, the new 40 mm low drag extended range projectile 100 will be able to accurately hit targets out to more than 500 meters compared to existing 40 mm low velocity rounds that are accurate out to just 400 meters. As was mentioned, obturator 108 is designed to decouple any appreciable obturator spin from a projectile body when fired in an M203 or M320 gun barrel notwithstanding the barrel's rifling. And, as was mentioned, the projectile body 111 is also decoupled from sabot(s) 109 to decouple any appreciable sabot spin from the projectile body when fired in an M203 or M320 gun barrel notwithstanding the barrel's rifling and therefore aids in the projectile not spinning after gun exist. The sabot air scoops 114 catch the air upon gun exist and this opens the sabot(s) which separate from the in-flight projectile (which consists of the fin 110, body 111 and nose 113). The projectile (fin 110, body 111 and nose 113) might be only very slowly spun up (less than 30 Hz spin rate) by the fins 110 where some/each of the fin blades could have a cant angle of 2 degrees for example there, upon a fin blade. Such a low spin rate would therefore allow guidance/sensors to be used with the projectile as was mentioned, which were not feasible for a high spin rate. This provides an extremely accurate projectile with extremely efficient aerodynamic properties as aforementioned. Longer body lengths can allow for more payloads and more lethality than current 40 mm ammunition. This 40 mm low drag extended range projectile 100 can form rounds that are less than 5 inches and can be used in the M203, and rounds made up to eight inches can be used in the M320. The many benefits of the new 40 mm low drag extended range projectile 100 according to this invention, further include the following. The new 40 mm low drag extended range projectile 100, as compared to current low velocity ammunition fired in a M203 or M320, can increase range from 400 meters to over 500 meters. The new 40 mm low drag extended range projectile 100 can increase maximum service velocity from 78 meters/second to over 120 meters/second (depending on quantity of propellant loaded) and is safe to fire in an M203 or M320 gun. The new 40 mm low drag extended range projectile 100 will fly a more straight trajectory compared to conventional low velocity ammunition and therefore could provide accurate lethality out to more than 500 meters compared to conventional 40 mm ammunition that is accurate only out to 350 meters. The new 40 mm low drag extended range projectile 100 can have more lethality than current 40 mm low velocity ammunition due to the increased length of the new round, and the new round also could carry more energetic material, and carry more fragmentation projectiles as cargo, at larger sizes, lengths, and calibers. The new 40 mm low drag extended range projectile 100 can be varied in length from four inches to eight inches by changing the body 111 length. The new 40 mm low drag extended range projectile 100 could be fired in either an M203 (at 4-5 inch length) or in an M320 (at 4-8 inch length). The 40 mm low drag extended range projectile 100 could be fired in an ordinary M320 gun. The new 40 mm low drag extended range projectile 100 is decoupled from spin in the M203 (or as in the M320) by the effect of slip obturator 108 and by the effect of body 111 free spinning from the sabot 109. The new cartridge case 102 has a copper closure cup 103 and case base plug 101 with a design which locks the propellant in closure cup 103 and case base plug 101 so that propellant cannot get into the new improved cartridge case 102 projectile area through vent holes 105. The improved cartridge case 102 holds more propellant and allows for more efficient propellant burn than a standard M203, M320 low velocity 40 mm cartridge case. Due to increased propellant and efficient burning, the 40 mm low drag extended range projectile 100 can have higher velocity and still be safe to fire in an M203 or M320. Further, the improved cartridge case 102 can be reused again and again, resulting in cost benefits thereby.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A 40 mm ammunition projectile for firing without significant spin in an M203 or an M320 grenade launcher, the projectile comprising:

a projectile cup;

a cylinder shaped spacer surrounded by a ring shaped spacer, wherein the cylinder shaped spacer and the ring shaped spacer are disposed inside the projectile cup an obturator;

a projectile body having hollow inner cavity;

a projectile fin assembly;

a projectile nose element having a conically shaped front area thereon;

an explosive payload loaded in cavity of said projectile body;

a projectile sabot enclosing said body, said sabot comprising two or more joining sabot petals;

a break ring;

a cartridge case;

vent holes in said cartridge case;

copper closure cup for placement in a bowl area of said cartridge case, said copper closure cup containing propellant, and;

a closure plug for threading into the rear of said cartridge case.

2. The projectile of claim 1 for launching in a M203 grenade launcher wherein the length of the projectile body is less than five inches.

3. The projectile of claim 2 wherein the length of the projectile body is four to five inches.

4. The projectile of claim 1 for launching in a M320 grenade launcher wherein the length of the projectile body is four to eight inches.

5. The projectile of claim 1 wherein the fin blades on fin assembly have a canted angle to relatively slowly spin up the projectile during firing.

6. The projectile of claim 1 wherein cartridge case can be reused repeatedly for cost benefits thereby.

7. The projectile of claim 1 wherein projectile cup is made from any of plastic, composite or metal.

8. The projectile of claim 1 wherein cartridge case has at least six vent holes.

9. The projectile of claim 1 wherein the explosive payload includes any of: selected energetic materials, an explosive liner, fragmentation projectiles or a selected warhead.

10. The projectile of claim 1 wherein closure cup has a lip for engaging base plug so that propellant cannot bleed into cartridge case projectile launching area through vent holes.

* * * * *